US008750749B2

(12) United States Patent
Suzuki et al.

(10) Patent No.: US 8,750,749 B2
(45) Date of Patent: Jun. 10, 2014

(54) CLEANING UNIT AND IMAGE FORMING APPARATUS

(75) Inventors: Akimichi Suzuki, Yokohama (JP); Shinsuke Kobayashi, Yokohama (JP); Kenji Takagi, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 138 days.

(21) Appl. No.: 13/428,196

(22) Filed: Mar. 23, 2012

(65) Prior Publication Data

US 2012/0243925 A1 Sep. 27, 2012

(30) Foreign Application Priority Data

Mar. 25, 2011 (JP) ..... 2011-068643

(51) Int. Cl.
*G03G 21/10* (2006.01)
*G03G 15/16* (2006.01)

(52) U.S. Cl.
USPC ..... 399/101; 15/256.51; 399/351

(58) Field of Classification Search
USPC ..... 399/101, 343, 345, 350, 351; 15/256.5, 15/256.51, 256.52
See application file for complete search history.

(56) References Cited

U.S. PATENT DOCUMENTS

| | | | | |
|---|---|---|---|---|
| 3,660,863 | A * | 5/1972 | Gerbasi | 399/351 |
| 7,711,308 | B2 * | 5/2010 | Hozumi et al. | 399/351 |
| 8,131,199 | B2 * | 3/2012 | Watanabe et al. | 399/350 |
| 2002/0009314 | A1 * | 1/2002 | Nakayama | 399/101 X |
| 2008/0166151 | A1 * | 7/2008 | Sur et al. | 399/101 |
| 2009/0324278 | A1 * | 12/2009 | Tomura et al. | 399/101 |
| 2012/0106996 | A1 * | 5/2012 | Kakehi | 399/101 X |

FOREIGN PATENT DOCUMENTS

| | | | |
|---|---|---|---|
| JP | 8-190288 | A | 7/1996 |
| JP | 2007-114392 | A | 5/2007 |
| JP | 2008-65230 | A | 3/2008 |

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes a rotatable member-to-be-cleaned having elasticity; a cleaning member, having elasticity, for removing a deposited matter deposited on the member-to-be-cleaned; and a supporting portion for supporting the cleaning member so that the cleaning member swings around a swing fulcrum. The swing fulcrum of the supporting portion is provided so that a force exerted from the member-to-be-cleaned onto the cleaning member with respect to a direction along a tangential line where the cleaning member and the member-to-be-cleaned contact each other during movement of the member-to-be-cleaned has a vector component in a direction in which the cleaning member is moved away from the member-to-be-cleaned.

9 Claims, 8 Drawing Sheets

(a)

(b)

COMPARATIVE ART

COMPARATIVE ART

CLEANING UNIT AND IMAGE FORMING APPARATUS

FIELD OF THE INVENTION AND RELATED ART

The present invention relates to a cleaning unit including a member-to-be-cleaned and a cleaning member for removing a deposited matter deposited on the member-to-be-cleaned and relates to an image forming apparatus including the cleaning unit.

In the image forming apparatus, after a developer image on a surface of a photosensitive drum is transferred onto a recording material, toner remains on the surface of the photosensitive drum in some cases. Further, in an image forming apparatus including an intermediary transfer belt, after the developer image on the surface of the intermediary transfer belt is transferred onto the recording material, the toner remains on the surface of the intermediary transfer belt in some cases. As a device for removing the toner remaining on the above-described photosensitive drum and intermediary transfer belt (hereinafter referred to as a member-to-be-cleaned), a cleaning unit including a cleaning member contacting the member-to-be-cleaned has been known. As a contact type in which a blade is used as the cleaning member and is contacted to the member-to-be-cleaned, a codirectional contact type in which the blade is codirectionally moved with respect to a rotational direction of the member-to-be-cleaned and a counterdirectional contact type in which the blade is counterdirectionally (reversely) moved with respect to the rotational direction of the member-to-be-cleaned.

From a viewpoint of a cleaning performance, the latter counterdirectional contact type is more preferred. In the counterdirectional contact type in which the cleaning performance is improved, a rise in contact pressure applied from the blade onto the member-to-be-cleaned and a rise in frictional force in a contact region are caused simultaneously. As a result, problems can arise such as a rise in load torque of a motor for driving the member-to-be-cleaned, abrasion (wearing) of the member-to-be-cleaned, an unusual noise due to vibration of the blade generated in the contact region, and worsening of the cleaning performance. Or, there can arise problems such as stop, breakage and the like of the device due to turning up of the blade at a contact portion between the blade and the member-to-be-cleaned and warp around of the blade toward a downstream direction of the member-to-be-cleaned.

Further, in recent years, with a tendency to improve an image quality, an average particle size of the toner tends to be decreased. In addition, there is an increasing opportunity of use of a uniform and high-circularity toner as represented by a toner manufactured by a polymerization method. In the case where the toner of small in particle size and high in circularity contacts the member-to-be-cleaned, there is a tendency that it is difficult to collect the toner by the blade. In order to collect such a toner with reliability, the blade is required to apply a larger urging force against the member-to-be-cleaned. An increase in surface urging force by the member-to-be-cleaned leads to further increase in frictional force between surfaces of the blade and the member-to-be-cleaned, thus resulting in a state in which turning-up and shuddering of the blade, the abrasion of a surface layer of the member-to-be-cleaned, and the like are liable to occur more than ever before.

Japanese Laid-Open Patent Application (JP-A) 2007-114392 has proposed that an angle formed by a rising shape which is formed at an upstream side of a movement direction of a member-to-be-cleaned by urging and slide-contacts a blade, which is a cleaning member, against the member-to-be-cleaned which is an elastic member is defined. As a result, the blade is urged against and slide-contacted to the member-to-be-cleaned to form an uneven portion by elastic deformation, so that a depositing force for depositing and carrying toner particles on the surface of the elastic member is reduced and thus a reduction in generated frictional force and a good cleaning performance are ensured.

However, in the constitution described in JP-A 2007-114392, in the case where an "apparent friction coefficient" between the cleaning member and a secondary transfer roller is increased, there is a possibility that the frictional force is increased. The "apparatus friction coefficient" referred to herein is defined as a value obtained by dividing a frictional force exerted on an urging sliding contact point between the cleaning member and the member-to-be-cleaned by normal reaction. That is, a friction coefficient obtained by taking into consideration and the member-to-be-cleaned but also a change in frictional force with a change in shape of the members and with a change in state of the members is defined as the "apparent friction coefficient".

The above-described rise in "apparent friction coefficient" occurs in the case where the cleaning member and the member-to-be-cleaned are abraded by continuous use, in the case where the members cause dimensional change with time, in the case where an operation environment is changed, and in the like case.

As the case where the cleaning member and the member-to-be-cleaned are abraded by continuous use, there are the case where a surface roughness of each of these members becomes smooth (small) by the continuous use and the abrasion occurs due to a true contact area between the cleaning member and the member-to-be-cleaned and the case where the abrasion occurs due to drop of a low-friction substance locally present on the surfaces of the members. As the case where the members cause the dimensional change with time, there is the case where the blade causes a creep phenomenon with time and as a result of abrasion occurs due to a so-called a tangential contact phenomenon such that a contact area of the cleaning member with the member-to-be-cleaned. Further, as the case where the "apparent friction coefficient" is increased by the change in environment change, there is the case where the cleaning member and the member-to-be-cleaned absorb moisture in a high-humidity environment to increase a liquid crosslinking force between the members.

SUMMARY OF THE INVENTION

A principal object of the present invention is to provide a cleaning unit and an image forming apparatus which are capable of stabilizing a frictional force between a blade (cleaning member) and a member-to-be-cleaned even when an "apparent friction coefficient" is fluctuated by a change with time or a change in operation environment.

According to an aspect of the present invention, there is provided an image forming apparatus comprising: a rotatable member-to-be-cleaned having elasticity; a cleaning member, having elasticity, for removing a deposited matter deposited on the member-to-be-cleaned; and a supporting portion for supporting the cleaning member so that the cleaning member swings around a swing fulcrum, wherein the swing fulcrum of the supporting portion is provided so that a force exerted from the member-to-be-cleaned onto the cleaning member with respect to a direction along a tangential line where the cleaning member and the member-to-be-cleaned contact each other during movement of the member-to-be-cleaned has a vector component in a direction in which the cleaning member is moved away from the member-to-be-cleaned.

According to another aspect of the present invention, there is provided a cleaning unit comprising: a cleaning member, having elasticity, for removing a deposited matter deposited on a member-to-be-cleaned having elasticity; and a supporting portion for supporting the cleaning member so that the cleaning member swings around a swing fulcrum, wherein the swing fulcrum of the supporting portion is provided so that a force exerted from the member-to-be-cleaned onto the cleaning member with respect to a direction along a tangential line where the cleaning member and the member-to-be-cleaned contact each other during relative movement between the cleaning member and the member-to-be-cleaned has a vector component in a direction in which the cleaning member is moved away from the member-to-be-cleaned.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

Parts (*a*)(*a*) and (*b*) of FIG. 1 are sectional views of structures of an image forming apparatus and a secondary transfer roller, respectively, in Embodiment 1 of the present invention.

Figure 6:
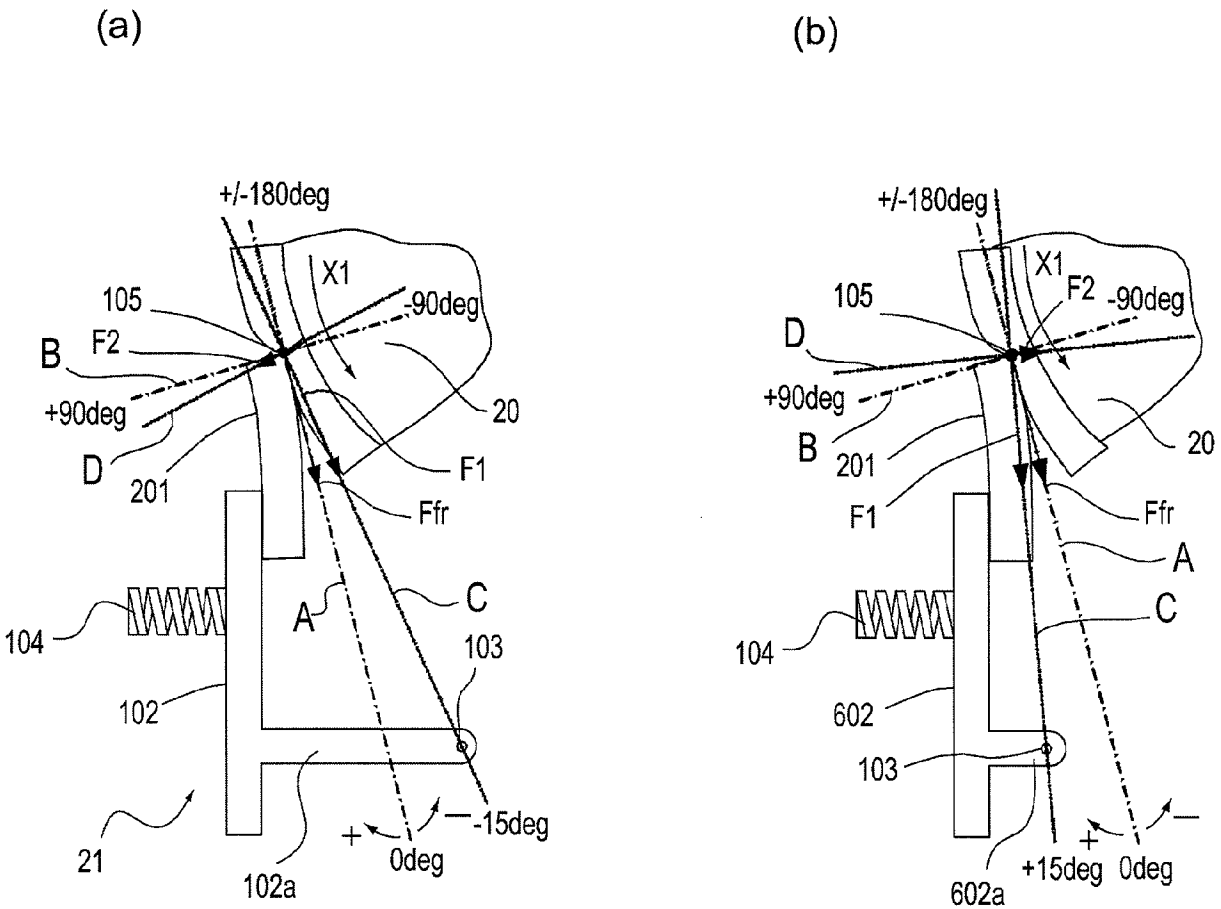

Parts (*a*)(*a*) and (*b*) of FIG. 6 are enlarged sectional views showing structures of cleaning units in Embodiment 1 and Comparative Embodiment 1, respectively.

Figure 7:
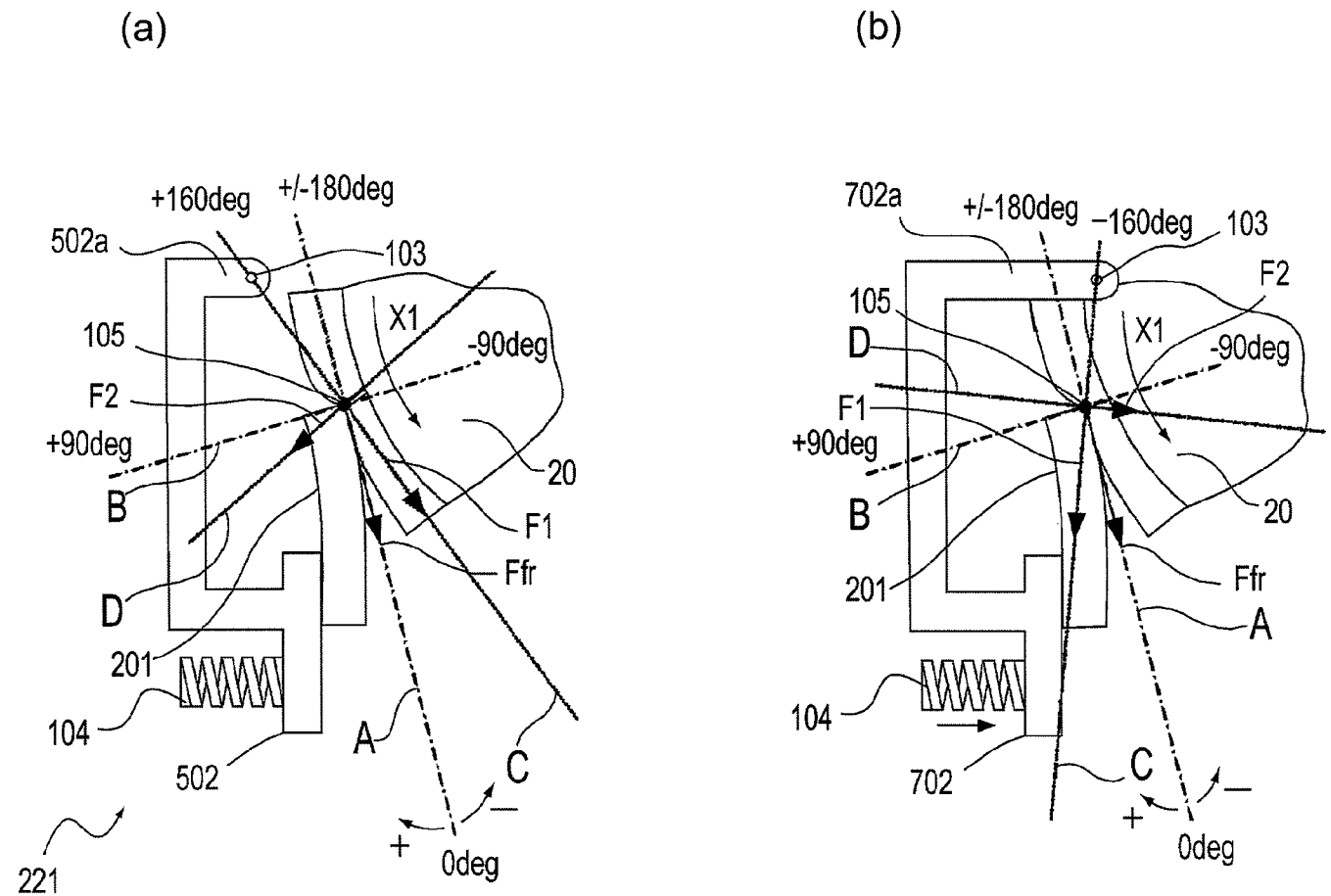

Parts (*a*)(*a*) and (*b*) of FIG. 7 are enlarged sectional views showing structures of cleaning units in Embodiment 2 and Comparative Embodiment 5, respectively.

Figure 8:
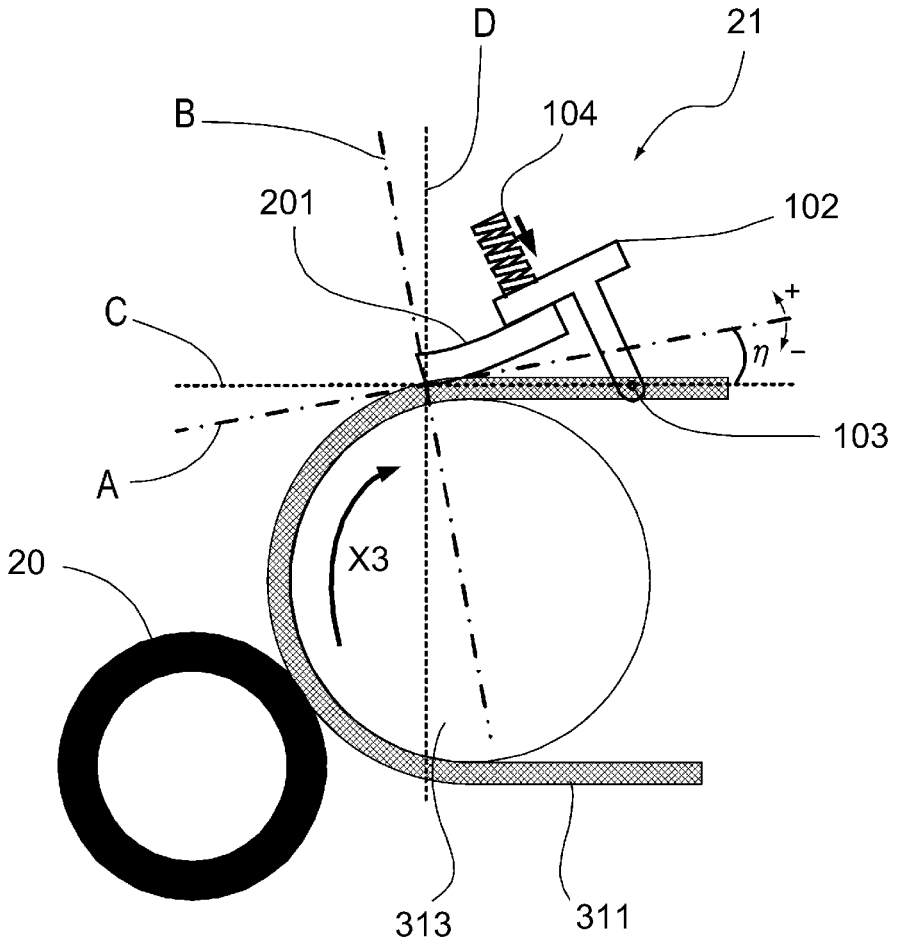

FIG. 8 is an enlarged sectional view showing a structure of a cleaning unit in Embodiment 4.

DESCRIPTION OF THE PREFERRED EMBODIMENTS

Hereinbelow, with reference to the drawings, preferred embodiments of the present invention will be exemplarily described in detail. However, dimensions, materials, shapes and relative configurations of constituent elements described in the following embodiments should be appropriately changed depending on constitutions and various conditions of cleaning units or image forming apparatuses to which the present invention is applied. Therefore, unless otherwise noted specifically, the scope of the present invention is not limited to those in the following embodiments.

Figure 1:
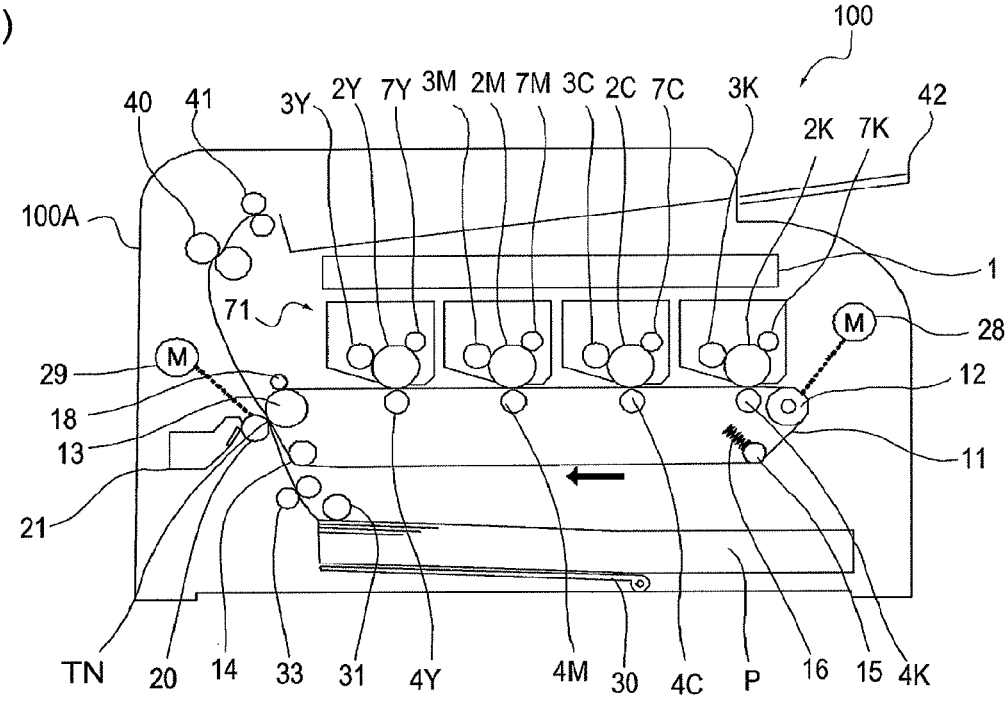
Figure 1:
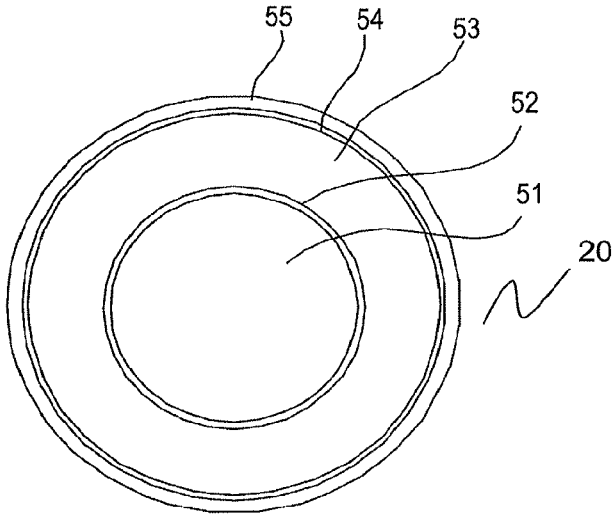

Part (*a*)(*a*) of FIG. 1 is a sectional view showing a structure of an image forming apparatus 100 according to Embodiment 1 of the present invention. The image forming apparatus 100 is an image forming apparatus which utilizes an electrophotographic image forming process. As shown in (*a*)(*a*) of FIG. 1, the image forming apparatus 100 includes a main assembly 100A thereof and inside the main assembly 100A, image forming portions 71 for forming images are provided. The image forming portions 71 includes photosensitive drums 2Y, 2M, 2C and 2K which are four image bearing members for yellow, magenta, cyan and black and which are juxtaposed (hereinafter referred to as photosensitive drums 2). Around the respective photosensitive drums 2, in the order from their upstream side of their rotational directions, primary chargers 7Y, 7M, 7C and 7K (hereinafter referred to as primary chargers 7) and developing units 3Y, 3M, 3C and 3K (hereinafter referred to as developing devices 3) are provided.

At positions where the photosensitive drums 2 oppose, an intermediary transfer belt 11 which is an intermediary transfer member onto which toner images formed on the surfaces of the photosensitive drums 2 are to be primary-transferred is stretched by a driving roller 12, an opposite roller 13, a tension roller 15 and a follower roller 14. As the intermediary transfer belt 11, a 100 μm-thick endless resin belt adjusted to have a volume resistivity of $10^{10}$ Ωcm by adding an ion electroconductive agent was used. As a material for the belt, in this embodiment, polyvinylidene fluoride (PVDF) was used.

As the driving roller 12, a roller prepared by coating a 0.5 mm-thick ethylene-propylene-dien (EPDM) rubber no a hollow aluminum pipe of 24 mm in outer diameter to provide an electric resistance of $10^5$Ω or less was used. The intermediary transfer belt 11 is rotationally driven in an arrow direction by a driving motor 28. The tension roller 15 is urged in one direction by a tension spring 16 to apply predetermined tension to the intermediary transfer belt 11. Via the intermediary transfer belt 11, at opposing positions to the photosensitive drums 2, primary transfer rollers 4Y, 4M, 4C and 4K (hereinafter referred to as primary transfer rollers 4) are provided.

To the intermediary transfer belt 11, a cleaning roller 18 for removing the toner (residual toner) deposited on the intermediary transfer belt 11 is provided and contacted and is rotated by rotation of the intermediary transfer belt 11. Via the intermediary transfer belt 11, at an opposing position to the opposite roller 13, a secondary transfer roller 20 is provided.

Part (*b*) of FIG. 1 is a sectional view showing a structure of the secondary transfer roller 20. As shown in (*b*) of FIG. 1, the secondary transfer roller 20 includes a core metal 51 formed of SUS in an outer diameter of 8 mm at its inner portion. Outside the core metal 51, an about 5 μm-thick primary layer 52, a 5 mm-thick NBR foam rubber layer 53, an about 5 μm-thick primer layer 54 and a 50 μm-thick polyimide resin tube 55 are provided in this order.

In this embodiment, the surface layer material was polyimide. Other than polyimide, it is also possible to provide a layer of resin materials such as polycarbonate, polyvinylidene fluoride (PVDF), polyethylene, polypropylene, polyamide, polysulfone, polyalylate, polyethylene terephthalate, polyether sulfone, and thermoplastic polyimide. Further, as the surface line, a resin-based curable layer of acrylic resin or the like or an elastic layer of a solid rubber or the like may also be provided.

The polyimide tube as an outermost layer had Rz of 0.5 μm, Rsm of 25 μm, an inner diameter 18 mm and a surface resistivity of $1\times10^2$ Ω·cm. The resistance of the NBR foam rubber layer was adjusted so as to provide a resistance of $1\times10^7$Ω to the secondary transfer roller 20. The electric resistance value was obtained from a current flowing through the secondary transfer roller 20 by bringing the secondary transfer roller 20 into contact with an aluminum cylinder of 30 mm in outer diameter in a state in which pressure of 5N is applied onto each of end portions of a core metal (not shown), by rotating the secondary transfer roller 20 by rotation of the aluminum cylinder and then by applying a DC voltage of +1 kV to the core metal (not shown).

The secondary transfer roller 20 is urged in one direction by an unshown spring and is driven by a driving motor 29. The secondary transfer roller 20 had an Asker-C hardness of 60 degrees under load of 9.8 N and had a micro-hardness of 78 degrees as measured by a micro-hardness meter ("Model MD-1", mfd. by Kobunshi Keiki Co., Ltd.). To the secondary transfer roller 20, a cleaning unit 21 is contacted ((*a*)(*a*) of FIG. 1).

In this embodiment, a substantially spherical toner which was manufactured by a toner polymerization method to have an average circularity of 0.96 or more and 1.00 or less was used. The average circularity of the toner was measured in the following manner. Measurement of the average circularity of the toner was made by using a flow-type particle image measuring device ("FPIA-2100", mfd. by Sysmex Corp.) and the average circularity was calculated by using the following equation.

Circularity=(peripheral length of circle having the same area as particle projection area)/(Peripheral length of particle projection image)

Here, the "particle projection area" refers to a binarized area of the toner particle image, and the "peripheral length of particle projection image" is defined as a length of a contour (edge) line obtained by connecting edge points of the toner particle image. The average circularity in the present invention is an index indicating a degree of unevenness of the toner particle, and is 1.000 in the case where the toner particle is a complete sphere and becomes a smaller value with a more complicated surface shape.

(Detailed Structure of Secondary Transfer Cleaning Portion)

Figure 2:
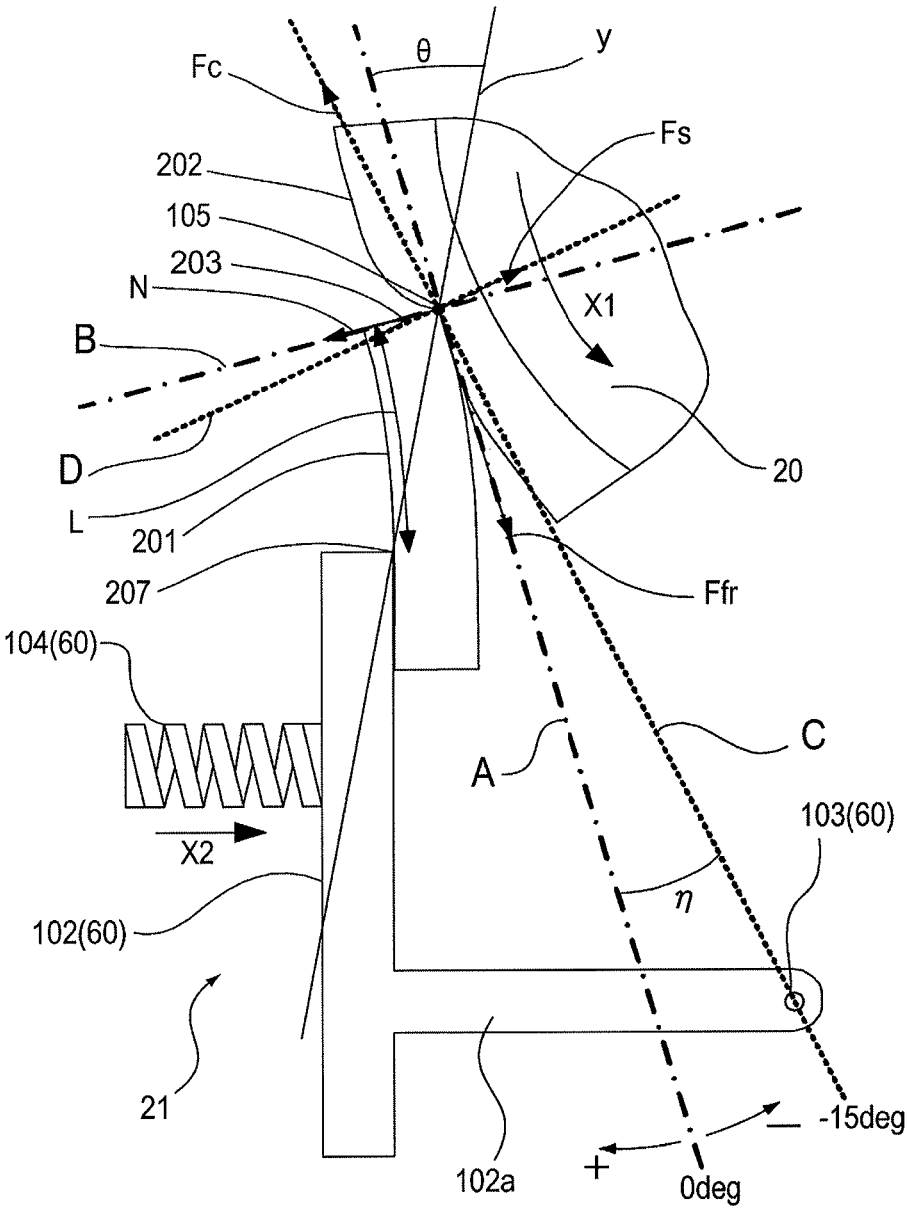
FIG. 2 is an enlarged view showing a structure of a cleaning unit.

FIG. 2 is an enlarged view showing a structure of the cleaning unit 21. The cleaning unit 21 includes the secondary transfer roller 20 and a blade 201 as the cleaning member. Here, a member-to-be-cleaned is the secondary transfer roller 20. The secondary transfer roller 20 is formed with an elastic member and is a member for transferring the developer image, which is transferred from the surface of the photosensitive drum 2 onto the intermediary transfer belt 11, onto a recording material (medium) P and is also a member-to-be-cleaned by the blade 201. The blade 201 as the cleaning member is formed with an elastic member and is a member for removing the developer and another deposited matter which are deposited on the secondary transfer roller 20, i.e., for cleaning the secondary transfer roller 20. The blade 201 is contacted to the secondary transfer roller 20 with respect to a counter direction (toward a direction opposite to a movement direction X1).

Further, the cleaning unit 21 includes an urging (pressing) mechanism 60. The urging mechanism 60 includes a blade supporting portion 102, a spring 104 as an urging member and a swing center point 103. The urging mechanism 60 urges the secondary transfer roller 20 so that the blade 201 swings around the swing center point 103 which is a swing fulcrum (swing supporting point).

The supporting portion 102 is a member for supporting the blade 201. The supporting portion 102 includes an arm 102*a* extending in an urging direction of the spring 104 and is provided with the swing center point 103 at an end portion of the arm 102*a*. The swing center point 103 is a center point around which the supporting portion 102 swings and rotates. Further, the spring 104 generates an urging force for urging the supporting portion 102 to bring the blade 201 into contact with the secondary transfer roller 20 in an arrow X2 direction with a desired pressure. Further, the cleaning unit 21 includes an unshown toner collecting container for containing the collected toner.

In this embodiment, the blade 201 was formed of urethane and had a thickness of 2 mm, a free length of 8 mm (L in FIG. 2) and a JIS-A hardness of 75 degrees. In this embodiment, the material for the blade 201 was polyurethane, but is not particularly limited but a general-purpose elastic material may frequently be used. For example, the material may also be various rubbers such as a silicone rubber, a fluorine-containing rubber, a natural rubber, SBR, BR, IR, NBR, CR, ACM, ANN and CSM.

An arrangement of the swing center point 103 in this embodiment will be described below. The secondary transfer roller 20 is moved relative to the blade 201 (rotated in an arrow X1 direction). Of a sliding contact portion where the blade 201 and the secondary transfer roller 20 slide-contact each other, an upstreammost point of the movement direction X1 in which the secondary transfer roller 20 moves is an upstreammost sliding contact point 105 (FIG. 2). A tangential line where the blade 201 and the secondary transfer roller 20 contact each other is a sliding contact line A.

In this case, the sliding contact line A is determined by taking into consideration a deformation state of the secondary transfer roller 20 which is the elastic member. Further, a thickness surface (or a cut surface) 203 of the blade 201 used in this embodiment is perpendicular to the sliding contact surface of the blade 201 and therefore the sliding contact line A was obtained as a normal to the thickness surface (cut surface) 203.

On the other hand, a line connecting the upstreammost sliding contact point 105 and the swing center point 103 in a swing fulcrum passing line C. When a downstream side of the sliding contact line A in the movement direction X1 of the secondary transfer roller 20 is taken as a reference (0 deg.) and when the clockwise rotational direction is taken as a positive (+) side, an angle formed between the sliding contact line A and the swing fulcrum passing line C is defined as a swing center position angle $\eta$ (180 deg.$\leq\eta\leq$+180 deg.). Further, an angle formed between the sliding contact line A and a supporting point passage line y connecting the upstreammost sliding contact point 105 and a supporting point 207 for supporting the blade 201 is defined as $\theta$. In this embodiment (FIG. 2), the swing center point 103 was disposed so that the swing center position angle $\eta$ was 15 deg. and the set angle $\theta$ was 25 deg.

The swing center point 103 is disposed at a position in which a frictional force Ffr exerted from the secondary transfer roller 20 onto the blade 201 in a direction along the sliding contact line A has a vector component for moving the blade 201 away from the secondary transfer roller 20 during movement of the secondary transfer roller 20 relative to the blade 201. Further, the swing center point 103 is located downstream of the upstreammost sliding contact point 105 with respect to the movement direction X1.

The swing fulcrum passing line C which is a rectilinear line passing through the upstreammost sliding contact point 105 and the swing center point 103 is located at a side closer to the secondary transfer roller 20 than the sliding contact line A, wherein the blade 201 and the secondary transfer roller 20 contact each other, in a region downstream of the upstreammost sliding contact point 105 with respect to the movement direction X1.

An image forming operation of the image forming apparatus 100 constituted as described above will be described with reference to (*a*) of FIG. 1. When the image forming operation is started, first the recording material P in a cassette 30 is fed by a feeding roller 31 and then is conveyed to a registration roller pair 33. Here, the registration roller pair at that time stops its rotation, and the recording material P is abutted against a nip of the registration roller pair 33 thereby to rectify oblique movement of the recording material P. With respect to the photosensitive drum 2Y, first the surface of the photosensitive drum 2Y is negatively charged uniformly by the primary charger 7Y and then is subjected to imagewise exposure by an exposure device 1. As a result, on the surface of the photosensitive drum 2Y, an electrostatic latent image corresponding to a yellow image component of an image signal is formed.

The developing unit 3 is a device for forming the developer image on the surface of the photosensitive drum 2 and is contacted to the photosensitive drum 2Y. The above electrostatic latent image is developed with a yellow toner which is negatively charged by the developing unit 3Y, thus being visualized as a yellow toner image. Then, the thus-obtained yellow toner image is primary-transferred onto the intermediary transfer belt 11 by the primary transfer roller 4Y supplied with a primary transfer bias. Such a series of the toner image forming operations is successively performed also with respect to other photosensitive drums 2M, 2C and 2K with predetermined timing. Then, the respective color toner images formed on the respective photosensitive drums 2 are successively primary-transferred superposedly onto the intermediary transfer belt 11 at respective primary transfer portions.

The four color toner images which are thus transferred superposedly onto the intermediary transfer belt 11 is moved to a secondary transfer nip TN with the rotation of the intermediary transfer belt 11 in the arrow direction.

Further, the recording material P which is subjected to rectification of the oblique movement by the registration roller pair 33 is sent to the secondary transfer nip TN while being timed to the images on the intermediary transfer belt 11. Thereafter, onto the recording material P, by the secondary transfer roller 20, the four color toner images on the intermediary transfer belt 11 are collectively secondary-transferred. In this way, the recording material P on which the toner images are transferred is then conveyed to a fixing device 40 and is heated and pressed, so that the toner images are fixed on the recording material P. Thereafter, the recording material P is discharged and stacked on a discharge tray 42 by a discharging roller pair 41.

Incidentally, the intermediary transfer belt 11 on which the secondary transfer is ended is subjected to removal of a transfer residual toner remaining on its surface by a cleaning roller 18 provided in the neighborhood of the opposite roller 13. Further, the residual toner deposited on the secondary transfer roller 20 is removed by the cleaning unit 21 and is conveyed to and stored in an unshown toner collecting container.

Next, a balance of forces generated at the sliding contact portion between the upstreammost sliding contact point 105 and the secondary transfer roller 20 is analytically solved by using a dynamic model, so that a frictional force generated between the members will be described. For the description, the balance of forces exerted on the upstreammost sliding contact point 105 is analytically solved by using the dynamic model. This is because although the contact portion (nip) between the blade 201 and the secondary transfer roller 20 has a width, a force approximately exerted on the sliding contact portion as a whole can be obtained by solving the balance of forces at an end portion of the blade 201 where stress is concentrated.

As shown in FIG. 2, on the upstreammost sliding contact point 105, four forces shown below are exerted and are balanced during rotation, so that the blade 201 can be apparently kept in a rest (stationary) state (FIG. 12).

(1) The frictional force Ffr which is a force exerted on the blade 201 by friction with the secondary transfer roller 20 acts in the direction along the sliding contact line A.

(2) A normal reaction N exerted from the secondary transfer roller 20 on the blade acts in the direction along the perpendicular line B perpendicular to the sliding contact line A.

(3) A pushing-back force Fc for pushing back the secondary transfer roller 20 by the blade 201 against the frictional force Ffr exerted on the blade 201 by friction with the secondary transfer roller 20 acts in the direction along the swing fulcrum passing line C.

(4) An urging force Fs for urging the secondary transfer roller 20 by the blade 201 acts in the direction along a perpendicular line D perpendicular to the swing fulcrum passage line C.

When the above-described forces are separated into components with respect to the direction along the swing fulcrum passing line C between the blade 201 and the secondary transfer roller 20 and the direction along the perpendicular line D and then a balance of these forces is formularized, the following formulas (equations) are obtained. Here, the angle formed by the sliding contact line A and the swing fulcrum passing line C is defined as the swing center position angle η (−180 deg.≤η≤180 deg.).

$$N=Fs\cdot\cos\eta-Fc\cdot\sin\eta \quad (1)$$

$$Ffr=Fc\cdot\cos\eta+Fs\cdot\sin\eta \quad (2)$$

Further, as a definition of the normal reaction N, the following formula (3) is obtained.

$$Ffr=\mu\cdot N \quad (3)$$

From the formulas (1) to (3), when Fc and N are eliminated and the formulas are solved with respect to Ffr, the following formula (4) is obtained.

$$Ffr = Fs\cdot\frac{\mu}{\cos\eta+\mu\cdot\sin\eta} \quad (4)$$

Figure 4:
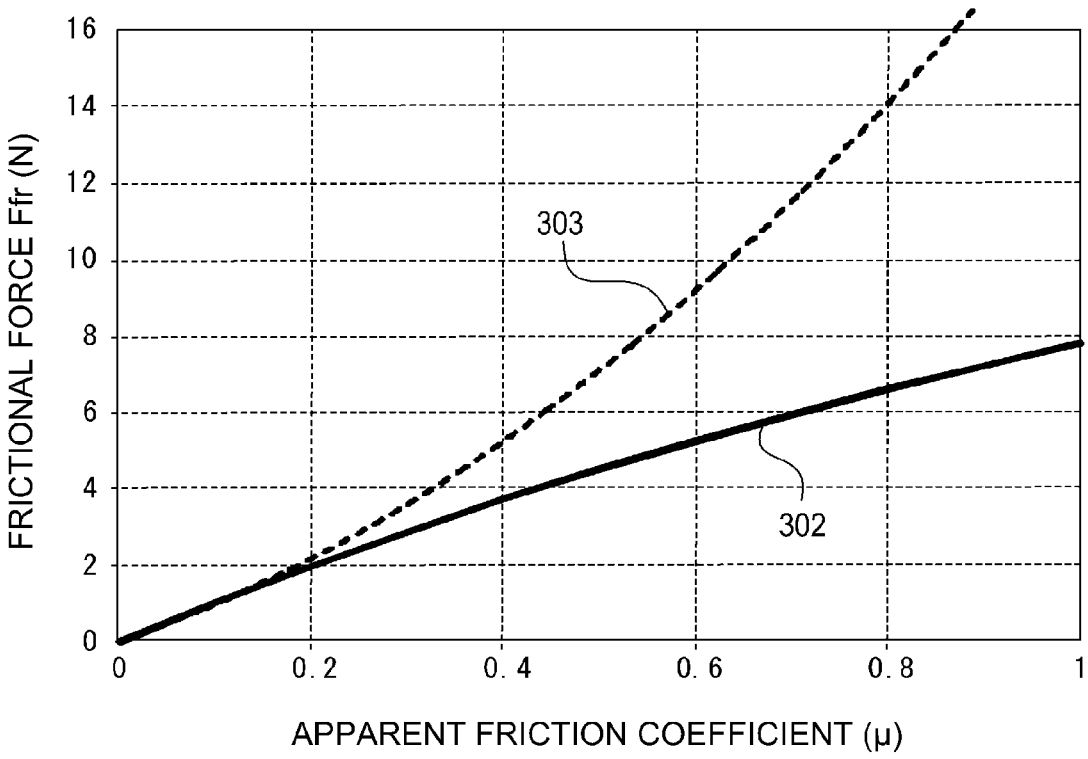
FIG. 4 is a graph showing a relationship between an apparent friction coefficient and a frictional force.

A result of calculation of the frictional force Ffr, exerted from the secondary transfer roller 20 on the blade 201, as a function of the apparent friction coefficient μ by substituting the urging force Fs and the swing center position angle η of the blade in Embodiment 1 (Fs=10 N, η=−15 deg.) into the formula (4) is represented by a solid line 302 in FIG. 4. In the constitution in this embodiment, from the formula (4), the frictional force Ffr is 5.2 N when the apparent friction coefficient μ is 0.6 and is 6.6 N when the apparent friction coefficient μ is 0.8. That is, in this embodiment, the apparent friction coefficient μ is increased by 33% and on the other hand the frictional force Ffr can be suppressed so that it is increased by 26%.

Figure 3:
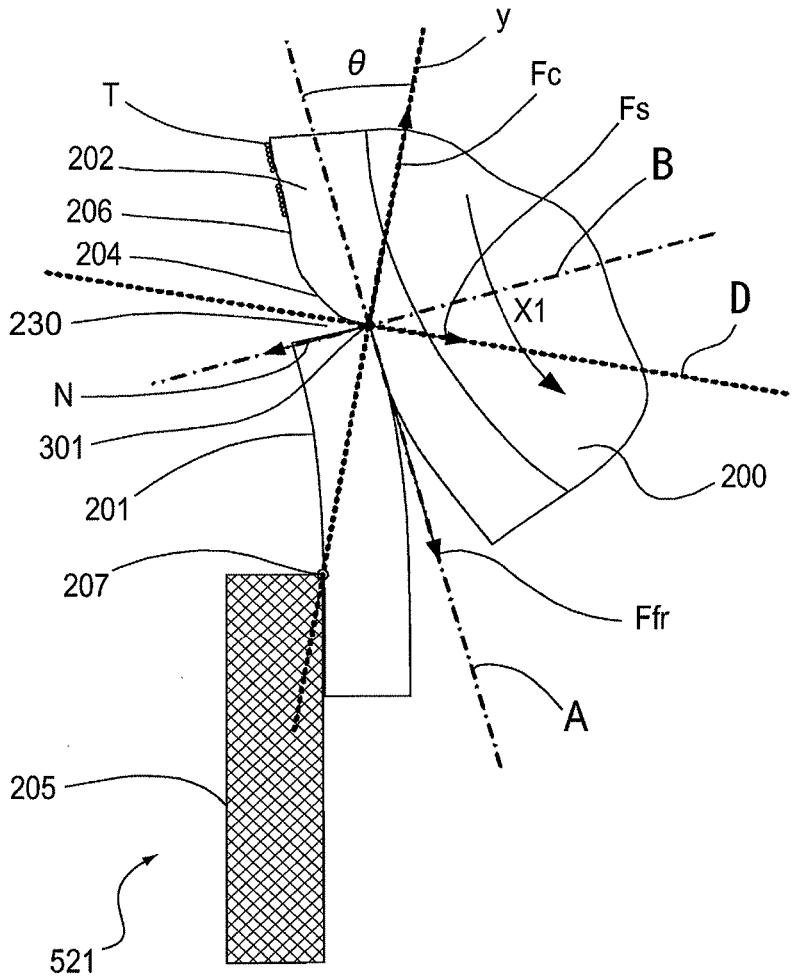
FIG. 3 is an enlarged view showing a structure of a conventional cleaning unit.

FIG. 3 is an enlarged view showing a structure of a cleaning unit 521 in a conventional embodiment. In a constitution of FIG. 3, as described above, the rise in "apparent friction coefficient" leads to an increase in frictional force. This reason will be described by analytically solving the balance of forces exerted on the upstreammost sliding contact point 105 by using the dynamic model. On an upstreammost sliding contact point 301, four forces shown below are exerted and are balanced during rotation, so that the blade 201 is apparently kept in a rest (stationary) state.

(5) The frictional force Ffr exerted on the blade 201 by friction with the secondary transfer roller 200 acts in the direction along the sliding contact line A.

(6) A normal reaction N exerted from the secondary transfer roller 200 on the blade acts in the direction along the perpendicular line B perpendicular to the sliding contact line A.

(7) A pushing-back force Fc for pushing back the secondary transfer roller 200 by the blade 201 against the frictional force Ffr exerted on the blade 201 by friction with the secondary transfer roller 200 acts in the direction along the supporting point passing line Y. Incidentally, in the constitution of the cleaning unit 521, a supporting portion 205 is not swung and therefore the swing fulcrum passing line C is not important but the supporting point passing line y becomes important.

(8) An urging force Fs for urging the secondary transfer roller 200 by the blade 201 acts in the direction along a perpendicular line D perpendicular to the supporting point passage line y.

When the above-described four forces are separated into components with respect to the direction along the supporting point passing line y and the direction along the perpendicular line D and then a balance of these forces is formularized, the following formulas (equations) (5) and (6) are obtained. Here, the angle formed by the sliding contact line A and the supporting point passing line y is defined as a set angle of the blade 201.

$$N=Fs\cdot\cos\theta+Fc\cdot\sin\theta \tag{5}$$

$$Ffr=Fc\cdot\cos\theta-Fs\cdot\sin\theta \tag{6}$$

Further, as a definition of the normal reaction N, the following formula (7) is obtained.

$$Ffr=\mu\cdot N \tag{7}$$

From the formulas (5) to (7), when Fc and N are eliminated and the formulas are solved with respect to Ffr, the following formula (8) is obtained. The frictional force Ffr exerted from the secondary transfer roller 200 as the member-to-be-cleaned on the blade 201 is represented by a function among the blade set angle θ, the urging force Fs and the apparent friction coefficient μ between the blade 201 and the secondary transfer roller 200.

$$Ffr = Fs\cdot\frac{\mu}{\cos\theta-\mu\cdot\sin\theta} = f(\theta, Fs, \mu) \tag{8}$$

FIG. 4 is a graph showing a relationship between the apparent friction coefficient μ and the frictional force Ffr. A result of calculation of the frictional force Ffr, exerted from the secondary transfer roller 20 on the blade 201, as a function of the apparent friction coefficient μ in the case where the urging force Fs is 10N and the blade set angle θ is 25 deg. with respect to the blade 201 having a longitudinal width of 230 mm is represented by a broken line 303 in FIG. 4. The frictional force Ffr is 9.2 N when the apparent friction coefficient μ is 0.6 and is 14.1 N when the apparent friction coefficient μ is 0.8. That is, the apparent friction coefficient μ is increased by 33% and on the other hand the frictional force Ffr is increased by 53%.

Figure 5:
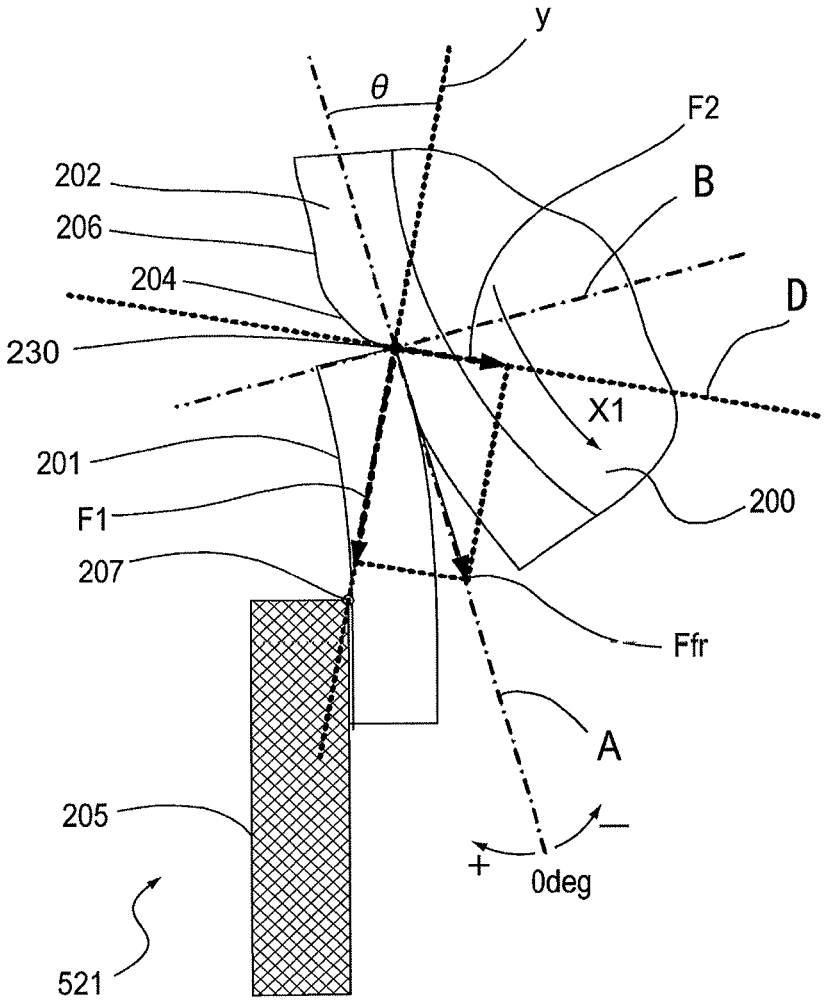
FIG. 5 is a schematic view for illustrating a conventional constitution in which a frictional force is divided into components in directions along a line passing through a swing fulcrum (swing supporting point) and along a line perpendicular to the line passing through the swing fulcrum.

FIG. 5 is a schematic view showing the conventional constitution in which the frictional force Ffr is separated into components with respect to the direction along the supporting point passing line y and the perpendicular line D. As described above, in the conventional constitution, the frictional force Ffr is increased move than the apparent friction coefficient. A generation mechanism of this tendency will be described. When the frictional force Ffr exerted on the blade 201 by friction with the secondary transfer roller 200 is separated, a force F1 acting in the direction along the supporting point passing line y and a force F2 acting in the direction along the perpendicular line D are obtained.

This force F2 is a force acting in a direction in which the blade 201 enters the secondary transfer roller 200, and the force F2 generated during the operation contributes to an increase in effective urging force of the blade 201. As a result, it would be considered that the frictional force Ffr is increased more than the apparent friction coefficient μ.

On the other hand, as described above in this embodiment, the apparent friction coefficient μ is increased by 33%, whereas the frictional force Ffr can be suppressed so that it is increased by 26%. In other words, compared with the constitution of FIG. 3, a fluctuation in frictional force Ffr relative to a fluctuation in apparent friction coefficient μ is small. This is because the force exerted on the blade 201 by friction with the secondary transfer roller 20 is converted into rotation movement in a direction in which the blade 201 is separated from the secondary transfer roller 20. As a result, the effective urging force Fs of the blade 201 is lowered, thus suppressing the rise in torque.

That is, with the case where the blade 201 and the secondary transfer roller 20 are abraded by continuous use, i.e., with the case where these members cause dimensional change with time, or with the case where the operation environment is fluctuated, even when the apparent friction coefficient μ is changed, the influence on the frictional force Ffr is small and thus a stable driving torque can be obtained. Further, the constitution in this embodiment is also advantageous in terms of shuddering, juddering and turning-up of the blade.

In the constitution in FIG. 3, the upstreammost sliding contact point 305 of the blade 201 urges the elastic member 202 on the secondary transfer roller 200. Then, at an urging portion, the elastic member 202 forms a recessed portion 230, and a portion corresponding to a recessed volume causes volume displacement to be elastically deformed such that a portion 204 protruded from a portion of a reference diameter of the circle (protruded portion) is formed at an upstream side of the movement direction of the secondary transfer roller 200. The secondary transfer roller 200 is rotated in the movement direction X1 relative to the blade 201 fixed on the supporting portion 205 in the apparatus main assembly 100A.

Toner particles T of the developer carried on the surface of the elastic member 202 are subjected to circumferential compressive stress at a transitional portion 206 from the portion of the circle reference diameter of the elastic member 202 to the protruded portion 204 and with movement toward a protrusion end of the protruded portion 204, the toner particles are in an open (free) state with respect to the circumferential direction by elongation of the elastic member 202. For that reason, due to this compression and stress of the open state with respected to the circumferential direction, the depositing force of the toner particles on the surface of the elastic member 202 is lowered, so that the blade 201 is urged and sliding-contacted in a state in which the toner particles are liable to be liberated from the surface of the elastic member 202. For that reason, the frictional force is reduced and a good cleaning performance is achieved. However, in such a conventional constitution, the force F2 (FIG. 5) is generated. Defective cleaning is liable to occur in the case where a foreign matter or an unevenness is prevent on the secondary transfer roller or in the case where a minute cut or the foreign matter is present on a cleaning edge line of the blade. This would be considered because these two members cannot follow such cases and thus cannot keep their intimate contact state or the toner particles pass through a minute space generated with a lowering in passing-preventing force.

However, both of the blade 201 and the secondary transfer roller 20 are the elastic member and therefore a following property between the two members becomes very high. For this reason, even during the operation, the intimate contact state between the two members can be kept, so that it becomes possible to ensure a stable cleaning property. As a result, even when the swing center position angle μ is made negative and the frictional force Ffr is converted into the rotation moment in the direction in which the blade 201 is separated from the secondary transfer roller 20, it becomes possible to ensure a sufficient intimate contact state between the both members, so that the cleaning property can be maintained.

In order to obtain the above-described effects, the hardness of the secondary transfer roller 20 is required to be 75 degrees or less (under load of 9.8 N) in terms of the Asker-C hardness and is required to be 95 degrees or less in terms of the micro-hardness as measured by the micro-hardness meter ("Model MD-1", mfd. by Kobunshi Keiki Co., Ltd.). With a lower hardness of the secondary transfer roller 20, the following property with respect to the blade 201 is improved. However, when the hardness of the secondary transfer roller 20 is excessively low, the blade 201 enters the secondary transfer roller 20, so that the driving torque is rather increased and behavior of the blade 201 is disturbed. Therefore, it is desirable that the hardness is 40 degrees or more (under load of 9.8 N) in terms of the Asker-C hardness and is 50 degrees or more in terms of the micro-hardness measured by the micro-hardness meter "Model MD-1", mfd. by Kobunshi Keiki Co., Ltd.).

Further, with respect to the hardness of the blade 201, when the hardness is excessively low, in the case where a necessary linear pressure for cleaning is applied, there is a possibility that shuddering of the blade due to stick-slip of the blade occurs or that the blade 201 is turned up. When the hardness is excessively high, as described above, a sufficient following property of the blade 201 with respect to the secondary transfer roller 20 cannot be obtained and therefore the defective cleaning occurs. For this reason, the hardness of the blade 201 may desirably be 60-90 degrees in terms of the JIS-A hardness.

An experiment was made by using various combinations including Embodiment 1 and Comparative Embodiments 1 to 4. A result of evaluation regarding a driving torque measurement of the secondary transfer roller 20, a blade shuddering (juddering) and a cleaning property is shown in Table 1. The evaluation was made in a low temperature (15° C.)/low humidity (10% RH) environment (LT/LH) and in a high temperature (30° C.)/high humidity (80% RH) environment (HT/HH). In HT/HH, it is understood that both of the blade 201 and the secondary transfer roller 20 absorb moisture and the apparent friction coefficient is increased by the influence of a liquid crosslinking force generated at an interface between the both members.

TABLE 1

| | MTC *1 | | SA-1 *3 | SA-2 *4 | 15° C./10% RH | | | 30° C./80% RH | | |
|---|---|---|---|---|---|---|---|---|---|---|
| EMB. NO. | (DEG.) | BSC *2 | (DEG.) | (DEG.) | TQ *5 | BS *6 | DC *7 | TQ *5 | BS *6 | DC *7 |
| EMB. 1 | EL(60) | SW | −15 | 25 | 5.2 | NO | NO | 6.8 | NO | NO |
| COMP. EMB. 1 | EL(60) | SW | +15 | 25 | 8.5 | NO | NO | 12.8 | YES | NO |
| COMP. EMB. 2 | EL(60) | FIX | | 25 | 8.8 | NO | NO | 14.0 | YES | NO |
| COMP. EMB. 3 | RI(80) | SW | −15 | 25 | 5.0 | NO | YES | 6.5 | NO | NO |
| COMP. EMB. 4 | RI(80) | SW | +15 | 25 | 5.0 | NO | NO | 8.0 | NO | NO |

*1 "MTC" is a member to be cleaned. "EL(60)" is an elastic member with Asker-C hardness of 60 degrees. "RI(80)" is a rigid member with Asker-C hardness of 80 degrees.

*2 "BSC" is a bade supporting structure. "SW" is a swing type. "FIX" is a fixed type.

*3 "SA-1" is a swing ange.

*4 "SA-2" is a set angle.

*5 "TQ" is a driving torque (N).

*6 "BS" is a blade shuddering. "YES" represnts that it is generated. "NO" represnts that it is not generated.

*7 "DC" is a defective cleaning. "YES" represnts that it is generated. "NO" represnts that it is not generated.

With respect to Embodiment 1, in both of LT/LH and HT/HH, there were no problem with respect to the blade shuddering and the cleaning property, and the torque rise with a change in environment was 1.6 N which was small.

In Comparative Embodiment 1, different from Embodiment 1, the swing center position angle η is +15 deg. As a result, the blade shuddering was generated in HT/HH and the torque rise with the change in environment was 4.3 N which was large. This would be considered because the swing center position angle η is set at +15 deg. which is the positive side and therefore the force exerted from the secondary transfer roller 20 on the blade 201 during the operation has a vector component in a direction in which the blade 201 enters the secondary transfer roller 20, thus increasing the frictional force.

In Comparative Embodiment 2, a supporting method of the blade 201 is of a fixed type. In the fixed type, the blade 201 is fixedly provided in the apparatus main assembly 100A. The set angle is an angle of the blade 201 set with respect to the secondary transfer roller 200 in the rest state and corresponds to the angle θ in FIG. 3. As a result, the blade shuddering was generated in HT/HH and the torque rise with the change in environment was 5.2 N which was large.

This is because the supporting point 207 (FIG. 3) for supporting the fixedly provided blade 201 is disposed at a positive side when the sliding contact line A (FIG. 3) is taken as a reference line. For this reason, similarly as in Comparative Embodiment 1, the force exerted from the secondary transfer roller 20 on the blade 201 during the operation has a vector component in a direction in which the blade 201 enters the secondary transfer roller 20, thus increasing the frictional force.

In Comparative Embodiment 3, as the member-to-be-cleaned, a rigid secondary transfer roller prepared by coating an iron core metal with a polyimide tube was used. As a result, and the torque rise with the change in environment was 4.3 N which was small but the defective cleaning was generated in LT/LH. This defective cleaning is generated because the swing center position angle η of the blade 201 is set at −15 deg. which is the negative side and therefore the force exerted from the secondary transfer roller on the blade 201 during the operation acts in a direction in which the blade 201 is separated from the secondary transfer roller 20. As a result, an adhesive property between the blade 201 and the secondary transfer roller which is a rigid member is not ensured, so that the defective cleaning is generated. On the other hand, the torque increase with the rise in friction coefficient resulting from the environment change can be suppressed.

In Comparative Embodiment 4, the rigid secondary transfer roller is used as the member-to-be-cleaned and the swing center position angle η is set at +15 deg. As a result, the torque rise with the change in environment was 3.0 N which was larger than that in Embodiment 1. With respect to the defective cleaning and the blade shuddering, allowable levels were obtained even in LT/LH.

In the constitution in Comparative Embodiment 4, the swing center position angle η is set at +15 deg. which is the positive side and therefore the force exerted from the secondary transfer roller 20 on the blade 201 during the operation has a vector component in a direction in which the blade 201 enters the secondary transfer roller 20, thus causing the increase in torque.

Further, it would be considered that the secondary transfer roller is the rigid member and therefore the blade 201 deforms and enters the secondary transfer roller and a contact area between these members is not readily increased, and thus the defective cleaning and the blade shuddering which are caused by the increase in contact area are not readily generated.

However, in Embodiment 1, the secondary transfer roller 20 is formed with the elastic member and therefore a contact nip with the opposing member is ensured, so that it becomes possible to ensure a stable secondary transfer property and a sheet (paper) feeding performance. On the other hand, in Comparative Embodiment 4, the secondary transfer roller 20 is formed with the rigid member and therefore the stable secondary transfer property and the sheet feeding performance cannot be obtained, so that there arises a problem such that improper transfer and oblique movement during the sheet feeding (a phenomenon that the paper is obliquely conveyed) are generated.

Therefore, according to this embodiment (Embodiment 1), in both of LT/LH and HT/HH, both of the blade shuddering and the cleaning property are of no problem and it is possible to suppress the rise in torque with the change in environment at a low level.

(Embodiment 2)

A constitution of a cleaning unit 221 in Embodiment 2 is shown in (*a*) of FIG. 7. In Embodiment 2, the constitution in which the position of the swing center point 103 is changed is compared with those in Comparative Embodiments, so that the reason that the functional effect of this embodiment is obtained and the scope of the present invention regarding the swing center position angle η are clarified. Incidentally, the constitution of Embodiment 2 is almost the same as that of Embodiment 1 and therefore the same constitution will be omitted from description.

In Embodiment 2 ((*a*) of FIG. 7) the swing center point 103 is located upstream of the upstreammost sliding contact point 105 with respect to the movement direction X1. Further, the swing fulcrum passing line C which is a rectilinear line passing through the upstreammost sliding contact point 105 and the swing center point 103 is located at a side closer to the secondary transfer roller 20 than the sliding contact line A, wherein the blade 201 and the secondary transfer roller 20 contact each other, in a region downstream of the upstreammost sliding contact point 105 with respect to the movement direction X1. In the cleaning unit 221, a supporting portion 502 is used in place of the supporting portion 102. Further, at an end portion of an arm 502*a* parallel to the urging direction of the spring 104 of the supporting portion 502, the swing center point 103 is provided, and the position of the swing center point 103 and the position of the upstreammost sliding contact point 105 are different from those in Embodiment 1.

In the constitution of Embodiment 2, the swing center point 103 is disposed so that the swing center position angle η+160 deg. As a comparative experiment with respect to this embodiment, the swing center position angle η was changed as shown in Table 2 below and evaluation regarding the driving torque measurement of the secondary transfer roller 20, the blade shuddering and the cleaning property was made.

TABLE 2

| | | MTC *2 | SA-1 *3 | SA-2 *4 | 15° C./10% RH | | | 30° C./80% RH | | |
|---|---|---|---|---|---|---|---|---|---|---|
| EMB. NO. | FIG *1 | (DEG.) | (DEG.) | (DEG.) | TQ *5 | BS *6 | DC *7 | TQ *5 | BS *6 | DC *7 |
| EMB. 2 | 7(a) | EL(60) | +160 | 25 | 5.5 | NO | NO | 7.0 | NO | NO |
| EMB. 1 | 6(a) | EL(60) | −15 | 25 | 5.2 | NO | NO | 6.8 | NO | NO |
| COMP. EMB. 1 | 6(b) | EL(60) | +15 | 25 | 8.5 | NO | NO | 12.8 | YES | NO |
| COMP. EMB. 5 | 7(b) | EL(60) | −160 | 25 | 8.1 | NO | NO | 12.0 | YES | NO |

*1 "FIG" is Figure showing a consitution of an associated embodiment.
*2 "MTC" is a member to be cleaned. "EL(60)" is an elastic member with Asker-C hardness of 60 degrees.
*3 "SA-1" is a swing ange.
*4 "SA-2" is a set angle.
*5 "TQ" is a driving torque (N).
*6 "BS" is a blade shuddering. "YES" represnts that it is generated. "NO" represnts that it is not generated.
*7 "DC" is a defective cleaning. "YES" represnts that it is generated. "NO" represnts that it is not generated.

In Embodiment 2 ((*a*) of FIG. 7), the swing center position angle η is set at +160 deg. The result was the substantially same as that in Embodiment 1 ((*a*) of FIG. 6). In both of LT/LH and HT/HH, both of the blade shuddering and the cleaning property were of no problem and the torque rise with the change in environment was 1.5 N which was small.

In Comparative Embodiment 1 ((*b*) of FIG. 6), the swing center position angle η is set at +15 deg. The result was, as described above, such that in HT/HH, the blade shuddering was generated and the torque rise with the change in environment was 4.3 N which was large. Incidentally, in Comparative Embodiment 1, a supporting portion 602 is used in place of the support portion 102, and at an end portion of an arm 602*a* extending in the urging direction of the spring 104 of the supporting portion 602, the swing center point 103 is provided.

In Comparative Embodiment 5 ((*b*) of FIG. 7), the swing center position angle η is set at −160 deg. The result was the substantially same as that in Comparative Embodiment 1, i.e., in HT/HH, the blade shuddering was generated and the torque rise with the change in environment was 3.9 N which was large. Incidentally, in Comparative Embodiment 1, a supporting portion 702 is used in place of the support portion 102, and at an end portion of an arm 702*a* extending in the urging direction of the spring 104 of the supporting portion 702, the swing center point 103 is provided.

A difference of this embodiment from Comparative Embodiments 1 and 5 will be described with reference to FIGS. 6 and 7. First, in Embodiment 2 ((*a*) of FIG. 7), the swing center position angle η is set at +160 deg. At the upstreammost sliding contact point 105, the blade 201 receives the frictional force Ffr from the secondary transfer roller 20 with respect to the direction along the sliding contact line A. Depending on a position where the swing center point 103 is disposed, whether the belt 201 has a vector component in the direction in which it is separated from the secondary transfer roller 20 or has a vector component in the direction in which it enters the secondary transfer roller 20 is determined.

In the case of this embodiment ((*a*) of FIG. 7), the frictional force Ffr is separated into vector components in the direction along the swing fulcrum passing line C. As a result, the frictional force Ffr is separated into F1 (the direction along the swing fulcrum passing line C) an F2 (the direction along the perpendicular line D). Here, the F2 is a force acting in a direction in which the pressure of the blade 201 is alleviated and by the F2, in the constitution in this embodiment, the force exerted from the secondary transfer roller 20 on the blade 201 during the operation acts in the direction in which the blade 201 is separated from the secondary transfer roller 20. As a result, even when the apparent friction coefficient μ is increased, it becomes possible to suppress the increase in frictional force Ffr.

Further, in this embodiment, the secondary transfer roller 20 is the elastic member and therefore the intimate contact property between the blade 201 and the secondary transfer roller 20 is ensured, so that although the blade 201 acts in the direction in which it is separated from the secondary transfer roller 20 during the operation, the cleaning property can be ensured.

Also in this case, similarly, the frictional force Ffr exerted on the blade 201 is separated into vector components in the direction along the swing fulcrum passing line C. As a result, the frictional force Ffr is separated into F1 (the direction along the swing fulcrum passing line C) an F2 (the direction along the perpendicular line D). In Comparative Embodiment 5, the F2 is a force acting in a direction in which the pressure of the blade 201 is increased and by the F2, in the constitution in this embodiment, the force exerted from the secondary transfer roller 20 on the blade 201 during the operation acts in the direction in which the blade 201 enters the secondary transfer roller 20. As a result, the increase in apparent friction coefficient μ accelerates the increase in frictional force Ffr. Also in Comparative Embodiment 1, by a similar function, the frictional force Ffr is increased.

As described above, the position of the swing center point 103 relative to the upstreammost sliding contact point 105 at the end portion of the blade 201 is changed, with the result that the swing center position angle η (FIG. 2) at which the functional effect of the present invention is obtained is as follows.

In the case where the swing center point 103 is located downstream of the upstreammost sliding contact point 105 with respect to the movement direction X1, 0 deg.>η>−90 deg. ((*a*) of FIG. 6) is satisfied. Further, in the case where the swing center point 103 is located upstream of the upstreammost sliding contact point 105 with respect to the movement direction X1, 180 deg.>η>+90 deg. ((*a*) of FIG. 7) is satisfied. In other words, at a downstream side of the upstreammost sliding contact point 105, when the swing fulcrum passing line C is located closer to the secondary transfer roller 20 than the sliding contact line A, passing the upstreammost sliding contact point 105, between the blade 201 and the secondary transfer roller 20, the following effect is obtained. That is, with respect to the increase sin apparent friction coefficient μ, an effect of suppressing the increase in frictional force Ffr can be obtained ((*a*) of FIG. 6 and (*a*) of FIG. 7).

Therefore, according to this embodiment (Embodiment 1), in both of LT/LH and HT/HH, both of the blade shuddering and the cleaning property are of no problem and it is possible to suppress the rise in torque with the change in environment at a low level.

(Embodiment 3)

A constitution of Embodiment 3 is almost the same as that of Embodiment 1 and therefore the same constitution will be omitted from description. Further, with respect to a constitution of Embodiment 3 different from that of Embodiment 1, i.e., borderless (frameless) printing mode peculiar to the constitution of Embodiment 3 will be described. In Embodiment 3, an operation in the borderless printing mode in which the developer image to be formed on the surface of the photosensitive drum 2 is formed in a region outside the recording material P onto which the developer image is to be transferred and then is transferred onto the recording material in a region extending to the edges of the recording material P can be executed.

In this embodiment, in addition to an operation in a normal printing mode using an image margin portion, the image forming apparatus is operable in the borderless printing mode in which the image is formed in a region extending to the edges of the recording material P. The borderless printing mode is selectable by an external device such as a host computer connected to the image forming apparatus. When a print controller (control means) receives a borderless print signal, an image formation control sequence depending on borderless printing is executed. When the operation in the borderless printing mode is executed, a masking region on the recording material P is set as a region larger than the recording material P by an additional printing region with a predetermined width (2 mm) each at a leading edge, a trailing edge, a left edge and a right edge of the recording material P.

Then, toner images are formed on the surfaces of the photosensitive drums 2Y, 2M, 2C and 2K in regions each including the additional printing region and then are transferred onto the intermediary transfer belt 11. The toner images are transferred onto the recording material P by the secondary transfer roller 20, so that the borderless printing for forming the image extending to the edge of the recording material P. The toner deposited on the surface of the secondary transfer roller 20 in the additional printing region is removed by the blade 201 in the cleaning unit 21. The recording material P on which the toner images are transferred is heated and pressed, so that the toner images are formed on the recording material P. The recording material P on which the toner images are fixed is discharged on the discharge tray 42 by the discharging roller pair 41, so that the image formation is ended.

The constitution of the cleaning unit 21 in this embodiment is exactly the same as that in Embodiment 1. However, for the reason described below, there are differences in blade cleaning property and frictional force and the like between the operation in the normal image forming (printing) mode with the margin and the operation in the borderless printing mode by a study made by the present inventors. The reason will be described.

The image formation region during the operation in the normal printing mode is located inside the recording material P and therefore the toner is little transferred onto the secondary transfer roller 20 during image formation. For this reason, a contact state between the blade 201 and the secondary transfer roller 20 is substantially uniform with respect to the longitudinal direction. On the other hand, the image formation region during the operation in the borderless printing mode includes a region outside the recording material P and therefore, during the secondary transfer, no toner is transferred inside the recording material region of the secondary transfer roller 20 but a so-called additional printing toner is transferred outside the recording material region of the secondary transfer roller 20. Thus, the blade 201 contacting the secondary transfer roller 20 contacts, during the secondary transfer, both of a portion where there is no toner and a portion where the toner is present.

During the execution of the blade cleaning, when the portion where there is no toner and the portion where the toner is present are adjacent to each other, a twisting force (torsion) is generated at their boundary portion, so that the defective cleaning can occur. This is because the toner also functioning as a lubricant causes a different in frictional force due to the adjacency on the secondary transfer roller 20 between the portion where there is no toner and the portion where the toner is present, so that the twisting force is generated in the blade 201.

With respect to the above constitution, an experiment using several combinations is conducted and a result of evaluation of the cleaning property during the operation in the borderless printing mode is shown in Table 3 below. An evaluation method in such that an image pattern of 100% black for the whole region is printed with setting of the masking region, for determining the printing region on the recording material P, so as to provide the additional printing region with the predetermined width (2 mm) at each of the leading edge, the trailing edge, the left edge and the right edge of the recording material P. Then, the evaluation was made as to whether or not the defective cleaning of the cleaning unit 21 was generated.

TABLE 3

| EMB. NO. | MTC*1 (DEG.) | BSC*2 | SA-1*3 (DEG.) | SA-2*4 (DEG.) | DC*5 |
|---|---|---|---|---|---|
| EMB. 3 | EL(60) | SW | −15 | 25 | NO |
| COMP. EMB. 6 | EL(60) | SW | +15 | 25 | YES |
| COMP. EMB. 7 | EL(60) | FIX | | 25 | YES |

*1"MTC" is a member to be cleaned. "EL(60)" is an elastic member with Asker-C hardness of 60 degre
*2"BSC" is a bade supporting structure. "SW" is a swing type. "FIX" is a fixed type.
*3"SA-1" is a swing ange.
*4"SA-2" is a set angle.
*5"DC" is a defective cleaning. "YES" represnts that it is generated. "NO" represnts that it is not generated.

In the constitution in this embodiment (Embodiment 3), the cleaning property was of no problem but both in the constitutions in Comparative Embodiments 6 and 7, the defective cleaning was generated in the neighborhood of the left and right edges of the recording material P. This may be attributable to an occurrence of the following phenomenon. During the execution of the toner transfer onto the recording material, a difference in frictional force between the portion inside the recording material where no toner as the lubricant is supplied and the portion outside the recording material where the toner is supplied becomes large and thus a behavior of the blade 201 is disturbed or the blade 201 is twisted.

The reason why the frictional force inside the recording material region on the secondary transfer roller 20 is increased is the same as that in Embodiment 1, i.e., that the frictional force generated between the blade 201 and the secondary transfer roller 20 has the vector component in the direction in which the blade 201 further enters the secondary transfer roller 20. On the other hand, in Embodiment 3, the swing center position angle η of the blade 201 is set at −15 deg., so that the frictional force generated between the blade 201 and the secondary transfer roller 20 has the vector component in the direction in which the blade 201 is separated from the secondary transfer roller 20.

(Embodiment 4)

FIG. 8 is an enlarged sectional view showing a structure of a cleaning unit 21 in Embodiment 4. The constitution of Embodiment 4 is almost the same as that of Embodiment 1 and therefore the same constitution will be omitted from description. The constitution of Embodiment 4 will be described with reference to FIG. 8. In Embodiment 4, the member-to-be-cleaned is an intermediary transfer rubber belt (elastic intermediary transfer member) 311 which is a transfer-receiving member onto which the developer image formed on the third of the photosensitive drum 2 is transferred. Further, the blade 201 is a blade for removing the developer and other deposited matters deposited on the intermediary transfer rubber belt 311, i.e., for cleaning the intermediary transfer rubber belt 311. Both of the intermediary transfer rubber belt 311 and the blade 201 are formed with an elastic member.

The intermediary transfer rubber belt 311 was prepared by coating a 1-10 μm thick resin coat layer containing the fluorine-containing resin on the surface of an endless elastic rubber belt which is adjusted to have a volume resistivity of about $10^{10}$ Ωcm by adding an ion electroconductive agent and which is 300 μm in thickness, 240 mm in width and 500 mm in peripheral length.

As the intermediary transfer rubber belt 311, chloroprene rubber was used in this embodiment but other than chloroprene rubber, it is also possible to use a rubber material such as urea rubber, silicone rubber, EPDM rubber (ethylene propylene rubber) or NBR (nitrile rubber) or to provide an elastic layer on the surface of the endless belt using the resin material as a base material. The hardness of the intermediary transfer rubber belt 311 was measured in a state in which it was wound around an opposite roller 313 provided inside thereof, and had the Asker-C hardness of 70 degrees (under load of 9.8 N). Via the intermediary transfer rubber belt 311, at an opposing position to the opposite roller 313, the secondary transfer roller 20 is provided. The opposite roller 313 rotates in a movement direction X3.

With respect to the constitution of the cleaning unit 21, also in this embodiment, the constitution is the same as that in Embodiment 1. That is, the cleaning unit 21 includes the blade 201, a supporting portion 102 for supporting the blade 201, a swing center point 103 around which the blade supporting portion is swung and rotated, and the spring 104 which is an urging member for urging the blade 201. Further, the supporting portion 102 is urged, so that the blade 201 is urged against the intermediary transfer rubber belt 311. The swing center point 103 was provided so that the swing center position angle η was −10 deg.

An experiment was made by using various combinations including Embodiment 4 and Comparative Embodiments 8 to 9. A result of evaluation regarding a driving torque measurement of the intermediary transfer rubber belt 311, a blade shuddering (juddering) and a cleaning property is shown in Table 4.

TABLE 4

| | MTC *1 | | SA-1 *3 | SA-2 *4 | 15° C./10% RH | | | 30° C./80% RH | | |
|---|---|---|---|---|---|---|---|---|---|---|
| EMB. NO. | (DEG.) | BSC *2 | (DEG.) | (DEG.) | TQ *5 | BS *6 | DC *7 | TQ *5 | BS *6 | DC *7 |
| EMB. 4 | EL(70) | SW | −10 | 25 | 6.0 | NO | NO | 7.1 | NO | NO |
| COMP. EMB. 8 | EL(70) | SW | +10 | 25 | 8.2 | NO | NO | 13.2 | YES | NO |
| COMP. EMB. 9 | EL(70) | FIX | | 25 | 8.5 | NO | NO | 14.0 | YES | NO |

*1 "MTC" is a member to be cleaned. "EL(60)" is an elastic member with Asker-C hardness of 60 degrees. "RI(80)" is a rigid member with Asker-C hardness of 80 degrees.
*2 "BSC" is a bade supporting structure. "SW" is a swing type. "FIX" is a fixed type.
*3 "SA-1" is a swing ange.
*4 "SA-2" is a set angle.
*5 "TQ" is a driving torque (N).
*6 "BS" is a blade shuddering. "YES" represnts that it is generated. "NO" represnts that it is not generated.
*7 "DC" is a defective cleaning. "YES" represnts that it is generated. "NO" represnts that it is not generated.

With respect to Embodiment 4, in both of LT/LH and HT/HH, there were no problem with respect to the blade shuddering and the cleaning property, and the torque rise with a change in environment was 1.1 N which was small.

In Comparative Embodiment 8, different from Embodiment 4, the swing center position angle η is +10 deg. As a result, the blade shuddering was generated in HT/HH and the torque rise with the change in environment was 5.0 N which was large. This would be considered because the swing center position angle η is set at +10 deg. which is the positive side and therefore the force exerted from the intermediary transfer rubber belt 311 on the blade 201 during the operation has a vector component in a direction in which the blade 201 enters the intermediary transfer rubber belt 311, thus increasing the frictional force.

In Comparative Embodiment 9, different from Embodiment 4, a supporting method of the blade 201 is of a fixed type. As a result, the blade shuddering was generated in HT/HH and the torque rise with the change in environment was 5.5 N which was large.

This is because the supporting point 207 (FIG. 3) for supporting the fixedly provided blade 201 is disposed at a position of +25 deg. when the sliding contact line A (FIG. 3) is taken as a reference line. For this reason, similarly as in Comparative Embodiment 8, the force exerted from the intermediary transfer rubber belt 311 on the blade 201 during the operation has a vector component in a direction in which the blade 201 enters the intermediary transfer rubber belt 311, thus increasing the frictional force.

According to the constitutions of Embodiments 1 to 4, the blade 201 is disposed swingably around the swing center point 103. Further, the swing center point 103 is disposed so that the frictional force Ffr exerted from the member-to-be-cleaned on the blade 201 has the vector component in the direction in which the blade 201 is separated from the member-to-be-cleaned. As a result, even when the "apparent friction coefficient" is fluctuated due to continuous use, change with time or operation environment change, the frictional force (torque) between the blade 201 and the member-to-be-cleaned is stabilized (fluctuation-suppressed), so that it is possible to alleviate the blade shuddering, the blade juddering and the defective cleaning.

Incidentally, the "continuous use" refers to, e.g., the case where the blade 201 and the secondary transfer roller 20 are abraded by continuous use. Further, the "change with time" refers to, e.g., the case where the blade 201 and the secondary transfer roller 20 are changed in dimension with time. Further, the "operation environment change" refers to, e.g., the case where an operation environment such as the temperature or the humidity is fluctuated.

Further, in the constitutions of Embodiments 1 to 4, both of the blade 201 and the secondary transfer roller 20 (the intermediary transfer rubber belt 311) are the elastic member and therefore even during the operation, the intimate contact state between the blade 201 and the secondary transfer roller 20 (the intermediary transfer rubber belt 311) can be maintained. For that reason, stable contact following property is ensured. As a result, a stable cleaning property is ensured.

Further, in the constitutions of Embodiments 1 to 4, the swing fulcrum passing line C is located closer to the member-to-be-cleaned than the sliding contact line A, where the blade 201 and the member-to-be-cleaned contact each other, in the region downstream of the upstreammost sliding contact point 105 with respect to the movement direction X1. Therefore, the blade 201 is swung around the upstreammost sliding contact point 105 in the direction in which the blade 201 is moved toward the member-to-be-cleaned. For that reason, the force received by the blade 201 due to the friction with the member-to-be-cleaned is converted into the rotation moment in the direction in which the blade 201 is separated from the member-to-be-cleaned. As a result, even in the case where the "apparent friction coefficient" is changed between the blade 201 and the member-to-be-cleaned, the fluctuation in frictional force (torque) is suppressed at a low level.

Also in the operation in the borderless mode in Embodiment 3, the stable cleaning property can be ensured. Incidentally, the constitution of Embodiment 3 is premised on the constitution of Embodiment 1 but may also be premised on the constitution of Embodiment 2.

Incidentally, in the constitution of Embodiment 4, the cleaning unit 21 in Embodiment 1 is incorporated but it is also possible to incorporate the cleaning unit 521 in Embodiment 2.

These and other objects, features and advantages of the present invention will become more apparent upon a consideration of the following description of the preferred embodiments of the present invention taken in conjunction with the accompanying drawings.

This application claims priority from Japanese Patent Application No. 068643/2011 filed Mar. 25, 2011, which is hereby incorporated by reference.

What is claimed is:

1. An image forming apparatus comprising:

a rotatable member-to-be-cleaned having elasticity;

a cleaning member, having elasticity, for removing a deposited matter deposited on said member-to-be-cleaned; and a supporting portion for supporting said cleaning member so that said cleaning member swings around a swing fulcrum, wherein an upstreammost sliding contact point is a most upstream point, with respect to a movement direction of said member-to-be-cleaned, along a sliding contact portion where said cleaning member and said member-to-be-cleaned slide-contact each other, wherein a tangential line where said cleaning member and said member-to-be-cleaned are in contact with each other during movement of said member-to-be-cleaned is a rectilinear line passing through the upstreammost sliding contact point, wherein the swing fulcrum is located downstream of the upstreammost sliding contact point with respect to the movement direction, and wherein, in a region downstream of the upstreammost sliding contact point with respect to the movement direction, a rectilinear line passing through the upstreammost sliding contact point and through the swing fulcrum is located closer to said member-to-be-cleaned than the tangential line where said cleaning member and said member-to-be-cleaned are in contact with each other.

2. An apparatus according to claim 1, wherein the swing fulcrum is provided at a member-to-be-cleaned side with respect to the tangential line where said cleaning member and said member-to-be-cleaned are in contact with each other.

3. An apparatus according to claim 1, further comprising an urging member for urging said supporting portion so that said cleaning member urges said member-to-be-cleaned.

4. An apparatus according to claim 1, wherein said cleaning member is a cleaning blade formed with a rubber.

5. An apparatus according to claim 1, wherein said member-to-be-cleaned is a secondary transfer roller for secondary-transferring a developer image, which is primary-transferred on an intermediary transfer member, onto a recording material, and wherein the secondary transfer roller includes a rubber layer.

6. An apparatus according to claim 1, wherein said member-to-be-cleaned is a belt for transferring a developer image onto a recording material, and wherein the belt includes a rubber layer.

7. An apparatus according to claim 1, wherein said apparatus is configured to execute an operation in a borderless printing mode in which a developer image to be formed on a surface of an image bearing member is formed in a region extending to an outside of a recording material, onto which the developer image is to be transferred, with respect to a widthwise direction of the image bearing member.

8. An image forming apparatus, comprising:

a rotatable member-to-be-cleaned having elasticity;

a cleaning member, having elasticity, for removing a deposited matter deposited on said member-to-be-cleaned; and a supporting portion for supporting said cleaning member so that said cleaning member swings around a swing fulcrum, wherein an upstreammost sliding contact point is a most upstream point, with respect to a movement direction of said member-to-be-cleaned, along a sliding contact portion where said cleaning member and said member-to-be-cleaned slide-contact each other, wherein a tangential line where said cleaning member and said member-to-be-cleaned are in contact with each other during movement of said member-to-be-cleaned is a rectilinear line passing through the upstreammost sliding contact point, wherein the swing fulcrum is located upstream of the upstreammost sliding contact point with respect to the movement direction, and wherein, in a region downstream of the upstreammost sliding contact point with respect to the movement direction, a rectilinear line passing through the upstreammost sliding contact point and through the swing fulcrum is located closer to said member-to-be-cleaned than the tangential line where said cleaning member and said member-to-be-cleaned are in contact with each other.

9. An apparatus according to claim 8, wherein the swing fulcrum is provided at a member-to-be-cleaned side with respect to the tangential line where said cleaning member and said member-to-be-cleaned are in contact with each other.

* * * * *